US012686478B2

(12) United States Patent
Weber et al.

(10) Patent No.: US 12,686,478 B2
(45) Date of Patent: Jul. 21, 2026

(54) INTEGRATED THRUSTER APPARATUS FOR A MARINE VESSEL

(71) Applicant: Steering Solutions IP Holding Corporation, Saginaw, MI (US)

(72) Inventors: John E. Weber, Pinconning, MI (US); Rodney M. Sanderson, Midland, MI (US); Christopher R. Douglas, Saginaw, MI (US); Andrew E. Maschke, Birch Run, MI (US); Philogene F. Rousseau, Freeland, MI (US)

(73) Assignee: Steering Solutions IP Holding Corporation, Saginaw, MI (US)

( * ) Notice: Subject to any disclaimer, the term of this patent is extended or adjusted under 35 U.S.C. 154(b) by 617 days.

(21) Appl. No.: 17/728,114

(22) Filed: Apr. 25, 2022

(65) Prior Publication Data

US 2022/0348300 A1 Nov. 3, 2022

Related U.S. Application Data

(60) Provisional application No. 63/244,381, filed on Sep. 15, 2021, provisional application No. 63/182,016, filed on Apr. 30, 2021.

(51) Int. Cl.
*B63H 11/08* (2006.01)
*B63B 1/12* (2006.01)
(Continued)

(52) U.S. Cl.
CPC ..... *B63H 11/08* (2013.01); *B63B 1/125* (2013.01); *B63B 35/34* (2013.01); *B63H 5/02* (2013.01); *B63B 2001/126* (2013.01)

(58) Field of Classification Search
CPC ..... B63H 11/08; B63H 5/02; B63B 1/125; B63B 35/34; B63B 2001/126
See application file for complete search history.

(56) References Cited

U.S. PATENT DOCUMENTS 3,342,032 A 9/1967 Cox et al.
4,214,544 A 7/1980 Dashew
(Continued)

FOREIGN PATENT DOCUMENTS

CN 201056295 Y 5/2008
CN 112278215 A 1/2021
(Continued)

OTHER PUBLICATIONS

Machine translation of KR-20160069607-A reference (Park et al.) (Year: 2016).*
(Continued)

*Primary Examiner* — Scott A Browne
*Assistant Examiner* — Jisun Choi
(74) *Attorney, Agent, or Firm* — Dickinson Wright PLLC

(57) ABSTRACT

A thruster system for a marine vessel includes an electric motor having an output shaft. The thruster system also includes a housing having a first housing opening and a second housing opening, the first housing opening defining a water intake, the second housing opening defining a water discharge. The thruster system further includes a rotatable member operatively coupled to, and driven by, the output shaft of the electric motor, wherein rotation of the rotatable member results in water brought into the housing through the first housing opening and expelled through the second housing opening to generate a thrust force in a direction that is greater than 45 degrees relative to a propeller direction of the marine vessel.

9 Claims, 12 Drawing Sheets

(51) Int. Cl.
*B63B 35/34* (2006.01)
*B63H 5/02* (2006.01)

(56) References Cited

U.S. PATENT DOCUMENTS

| | | | | |
|---|---|---|---|---|
| 4,807,552 | A | 2/1989 | Fowler | |
| 5,282,763 | A | 2/1994 | Dixon | |
| 6,142,841 | A | 11/2000 | Alexander, Jr. et al. | |
| 6,350,164 | B1 | 2/2002 | Griffith et al. | |
| 6,568,341 | B1 | 5/2003 | Sosa | |
| 6,612,253 | B1 | 9/2003 | Kuhlman | |
| 7,121,219 | B1 | 10/2006 | Stallings | |
| 7,789,032 | B1 | 9/2010 | McDugle et al. | |
| 8,701,581 | B2 | 4/2014 | Byle et al. | |
| 8,727,823 | B2 | 5/2014 | Fletcher et al. | |
| 8,911,271 | B2 | 12/2014 | Shibayama | |
| 9,108,710 | B1 | 8/2015 | McChesney et al. | |
| 9,738,364 | B2 | 8/2017 | Abney | |
| 10,160,530 | B1 | 12/2018 | Howell et al. | |
| 10,232,921 | B2 | 3/2019 | Ayotte et al. | |
| 10,427,770 | B1 | 10/2019 | Guidry | |
| 11,167,822 | B2 | 11/2021 | Michaeli et al. | |
| 11,208,188 | B2 | 12/2021 | Fishburn et al. | |
| 2004/0266280 | A1 | 12/2004 | Jones | |
| 2005/0112989 | A1 | 5/2005 | Yourk | |
| 2005/0247252 | A1 | 11/2005 | Brown | |
| 2009/0101056 | A1 | 4/2009 | Waldo | |
| 2017/0203823 | A1 | 7/2017 | Abney | |
| 2020/0385097 | A1* | 12/2020 | Fishburn | B63B 35/34 |
| 2021/0094661 | A1* | 4/2021 | Schmid | B63B 29/02 |
| 2021/0094665 | A1 | 4/2021 | Schmid et al. | |

FOREIGN PATENT DOCUMENTS

| | | | | |
|---|---|---|---|---|
| CN | 113291444 | A | | 8/2021 |
| DE | 2330829 | A | | 1/1975 |
| JP | 84840189 | A | | 6/1973 |
| JP | 2001039389 | A | * | 2/2001 |
| KR | 100889975 | B1 | | 3/2009 |
| KR | 20150041865 | A | | 4/2015 |
| KR | 20160006943 | A | | 1/2016 |
| KR | 20160069607 | A | * | 6/2016 |
| RU | 2700080 | C1 | | 9/2019 |
| TW | 550211 | B | | 9/2003 |
| WO | 2011139732 | A2 | | 11/2011 |
| WO | 2016166620 | A1 | | 10/2016 |
| WO | 2017039742 | A9 | | 3/2017 |
| WO | 2021164777 | A1 | | 8/2021 |

OTHER PUBLICATIONS

Machine translation of JP_2001039389_A (Year: 2001).*
Services manual Jet Thruster 2011—Present Models & Dufour Factory installations, Holland Marine Parts B.V., https://irp-cdn.multiscreensite.com/265d2296/files/uploaded/D-037-01%20Service%20Manual.pdf (Year: 2011).*
Office Action regarding corresponding AU App. No. 2022202829; issued Jul. 12, 2023.
Jet Thruster Combi: Bow & Stern Thruster / https://www.jetthruster.com/; accessed by internet Mar. 8, 2022.
6-12V Spray Water Thruster / https://www.eassymall.com/product/6-12v-spray-water-thruster-for-rc-fishing-boats-motorboat-jet-pump-diy; accessed by internet Jun. 2021.
https://sideshift.com/products/pontoon-thrusters/; retrieved from the internet Jul. 6, 2022.
https://www.capsante.com; accessed via internet Jul. 22, 2022.
Office Action regarding corresponding DE App. No. 10 2022 110 483.4; issued Sep. 17, 2024.

* cited by examiner

INTEGRATED THRUSTER APPARATUS FOR A MARINE VESSEL

CROSS-REFERENCE TO RELATED APPLICATIONS

This application claims the benefits of priority to U.S. Provisional Patent Application Ser. No. 63/244,381, filed Sep. 15, 2021, as well as U.S. Provisional Patent Application Ser. No. 63/182,016, filed Apr. 30, 2021, the disclosure of each incorporated by reference herein in its respective entirety.

FIELD OF THE INVENTION

The disclosure herein relates to marine vessels and, more particularly, to a maneuvering thruster system and method for shallow draft marine vessels.

BACKGROUND

V-hull low-speed or no-speed lateral boat control often utilizes a bow and/or stern thruster. A thruster is a small ducted prop driven by an electric motor. Thrusters are mounted permanently into the bow of the boat near the keel (underwater). Thrusters allow an operator to control the position of the vessel by swinging the bow left and right while at dock, or in any other situation that calls for low speed maneuverability. This movement is perpendicular to the axis of travel offered by propulsion units, as thrusters are not used for forward propulsion.

Bow thrusters are currently manufactured, but they are not able to be used in shallow draft boats (e.g., pontoon, barge, airboat, etc.) due to the low displacement of the hulls. For example, the bow of a V-hull might be approximately 12 inches underwater, while the bow of a pontoon boat could be have as little as 2 inches underwater. Mounting a regular bow thruster on a pontoon boat would place the ducted propeller in the air and thus render it useless.

Near dock maneuverability for pontoon type boats may be made with utilization of a design requiring two electric motors with propellers. These are essentially electric trolling motors with shortened shafts and actuator control. One is located at the transom and one is at the bow. While running at speed, the motors are folded up out of the water under the deck of the boat. When at dock, they are deployed into the water and controlled with a joystick at the helm. This allows the boat operator better control of the boat at dock.

The electric trolling motors suffer from various shortcomings. First, such motors are frail, as the thin motor shafts are easily damaged if objects are struck. The motors are complex since actuators are required to deploy and to control the apparatus. The motors are unsightly, as they are very clunky. Finally, the motors are simply a bolt-on design, which is not a clean, aesthetically pleasing solution.

SUMMARY OF THE DISCLOSURE

According to one aspect of the disclosure, a thruster system for a marine vessel includes an electric motor having an output shaft. The thruster system also includes a housing having an intake opening and a discharge opening, the intake opening defining a water intake, the discharge opening defining a water discharge. The thruster system further includes a rotatable member operatively coupled to, and driven by, the output shaft of the electric motor, wherein rotation of the rotatable member results in water brought into the housing through the intake opening and expelled through the discharge opening to generate a thrust force in a direction that is greater than 45 degrees relative to a propeller direction of the marine vessel.

According to another aspect of the disclosure, a pontoon boat includes a first pontoon. The pontoon boat also includes a second pontoon. The pontoon boat further includes a first thruster system mounted to the first pontoon, the first thruster comprising a first electrically driven pump having an intake on a bottom portion thereof and a discharge opening on a side of the pump housing, wherein operation of the electrically driven pump results in water brought into the pump housing through the intake and expelled through the discharge opening to cause a thrust force in a first thrust direction. The pontoon boat yet further includes a second thruster system mounted to the second pontoon, the second thruster comprising a second electrically driven pump having an intake on a bottom portion thereof and a discharge opening on a side of the pump housing, wherein operation of the electrically driven pump results in water brought into the pump housing through the intake and expelled through the discharge opening to case a thrust force in a second thrust direction that is opposite to the first thrust direction, wherein the first thrust direction and the second thrust direction are each perpendicular to a propeller direction of the pontoon boat.

According to yet another aspect of the disclosure, a thruster system for a marine vessel includes an electric motor proximate a pontoon and having an output shaft with a belt pulley, wherein the output shaft is configured to at least rotate in a clockwise direction or counter-clockwise direction. The thruster system also includes a belt disposed along an outside periphery of the pontoon and coupled to the belt pulley, wherein the belt is configured to at least move in a clockwise direction or counter-clockwise direction as the output shaft at least rotates in the clockwise direction or counter clockwise direction. The thruster system further includes a plurality of paddles coupled to the belt, wherein the plurality of paddles extend generally outward from the outside periphery of the pontoon, and wherein the plurality of paddles are configured to actively contact water as the belt moves in at least the clockwise direction or counter-clockwise direction.

These and other advantages and features will become more apparent from the following description taken in conjunction with the drawings.

BRIEF DESCRIPTION OF THE DRAWINGS

The subject matter that is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

Referring now to the Figures, where the invention will be described with reference to specific embodiments, without limiting same, exemplary embodiments of a maneuvering thruster system and method for shallow draft marine vessels are illustrated.

Figure 1B:
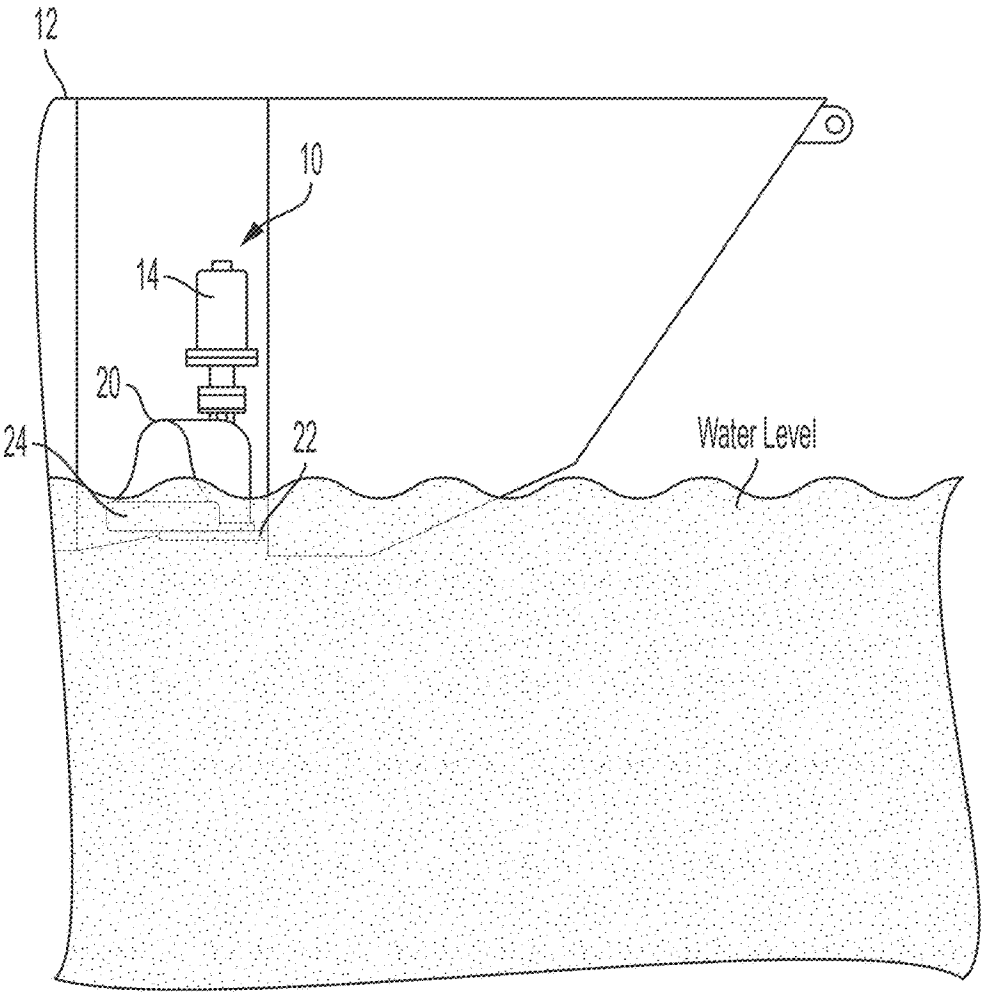
FIG. 1B is a side, elevation, schematic illustration of the thruster system.
Figure 1A:
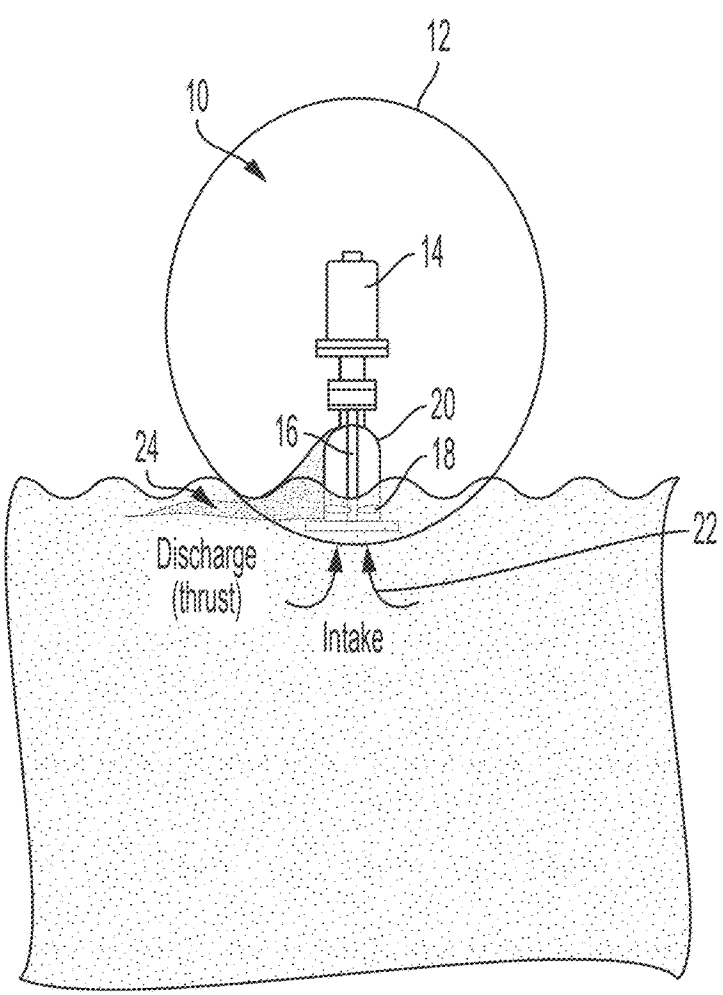
FIG. 1A is a front, elevation schematic illustration of a thruster system for a marine vessel.

Referring to FIGS. 1A and 1*i*, schematically illustrated is a thruster system for a marine vessel. The thruster system is referenced generally with numeral 10. The marine vessel may be any type of shallow draft marine vessel, such as a pontoon boat, for example. A portion of a pontoon 12 is illustrated in FIGS. 1A and 1B. In particular, the general location and orientation of the thruster system 10, relative to the pontoon 12, is shown. In FIG. 1A, the view is from an end of the pontoon 12, such that the view into the page substantially aligns with a direction of longitudinal travel provided by a main propeller of the marine vessel (i.e., from longitudinal front to rear). In FIG. 1B, the view is from a side of the pontoon 12. As shown, the pontoon 12 does not penetrate the water surface to a large depth. The embodiments of the thruster system 10 described herein provide operator control over maneuvers that are desired at or near a dock or in other low speed situations. Such maneuvers may include side-to-side movement that is substantially perpendicular to a propeller direction of the marine vessel. Additionally, small radius rotation of the marine vessel is also controllable with the thruster system 10. These benefits are provided, while addressing the challenges posed by the aforementioned shallow depth that is available.

The thruster system 10 includes a motor 14 that is an electric motor, a driveshaft 16 operatively driven by the electric motor 14, and a rotatable member 18 driven by the driveshaft 16. In some embodiments, the motor 14 may be a hydraulic, pneumatic, or other type of motor, so long as the motor 14 can drive the driveshaft 16. The rotatable member 18 is located within a pump housing 20. The pump housing 20 includes an intake opening 22 that is defined in a bottom portion of the pump housing 20. By locating the intake opening 22 on the bottom portion of the pump housing 20, the low water depth penetration is nullified, as water is taken vertically upward into the pump housing 20 during rotation of the rotatable member 18. The pump housing 20 also includes a discharge opening 24 located on a side portion of the pump housing 20. Expulsion of water through the discharge opening 24 during operation of the rotatable member 18 creates a thrust force that is in a substantially sideways direction relative to the propeller direction of the marine vessel. In some embodiments, the angle of the thrust direction is greater than 45 degrees relative to the propeller direction, while in other embodiments the thrust direction is greater than 80 degrees relative to the propeller direction, and in other embodiments the thrust direction is substantially perpendicular to the propeller direction.

The overall thruster system 10 may be mounted to any suitable portion of the marine vessel hull, such as the pontoon 12 in the illustrated embodiments. As shown in the Figures, the thruster system 10 may be located within a thruster chamber of the pontoon 12. Alternatively, the thruster system 10 may be mounted to a side of the pontoon 12. Regardless of the precise location of the thruster system 10, it is permanently mounted and does not require repeated manipulation to put it in place for operation. Therefore, the thruster system 10 does not pivot or translate in and out of the water to carry out the maneuvering operations disclosed herein.

Figure 2:
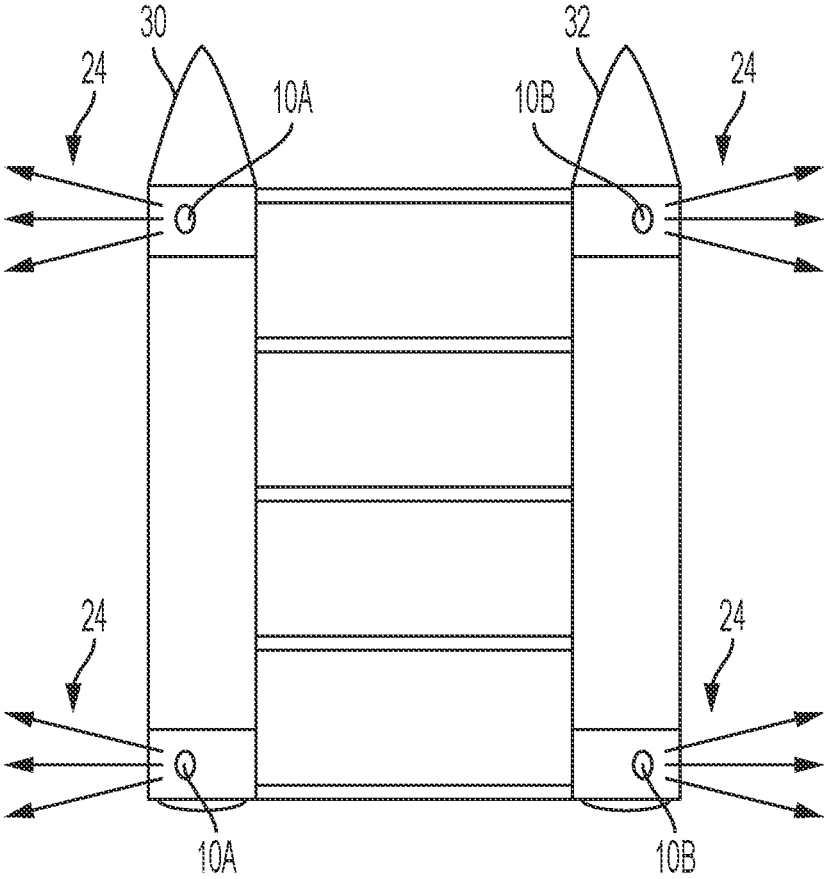
FIG. 2 is a schematic illustration a two-pontoon boat having four thruster systems and showing the thrust direction of each thruster system.

Referring now to FIG. 2, a two-pontoon marine vessel configuration is shown. Specifically, a first pontoon 30 and a second pontoon 32 are included. In the illustrated embodiment, each pontoon 30, 32 includes a pair of thruster systems, with the pair associated with first thruster 30 referenced with 10A and the pair associated with the second thruster referenced with 10B. Each pair 10A, 10B is spaced longitudinally along the pontoon 30, 32 from each other, but the discharge openings 24 of each pair are oriented substantially parallel to each other, such that each thruster system 10 is capable of providing a sideways directed thrust, i.e., substantially perpendicular relative to the main propeller thrust direction. It is to be appreciated that embodiments having thrust directed at non-perpendicular angles is contemplated.

Figure 3A:
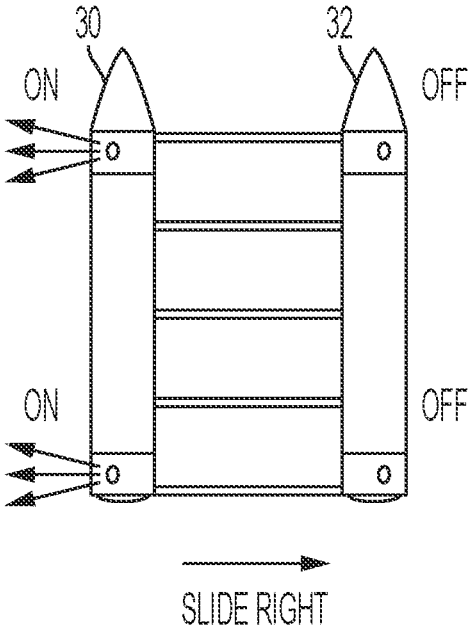
FIG. 3A is a diagram illustrating a first operating condition of the four thruster systems.
Figure 3B:
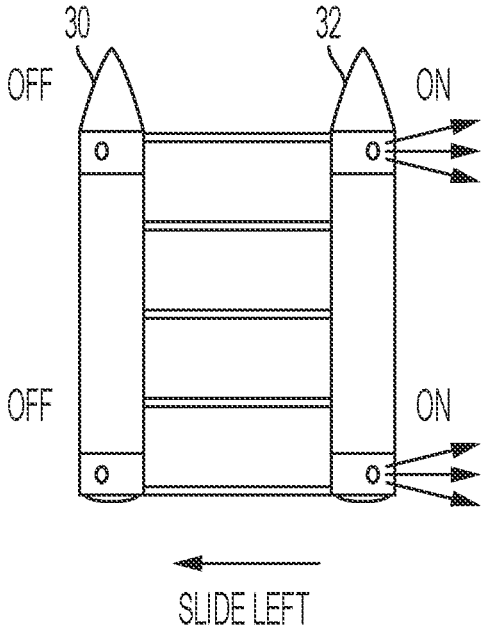
FIG. 3B is a diagram illustrating a second operating condition of the four thruster systems.
Figure 3C:
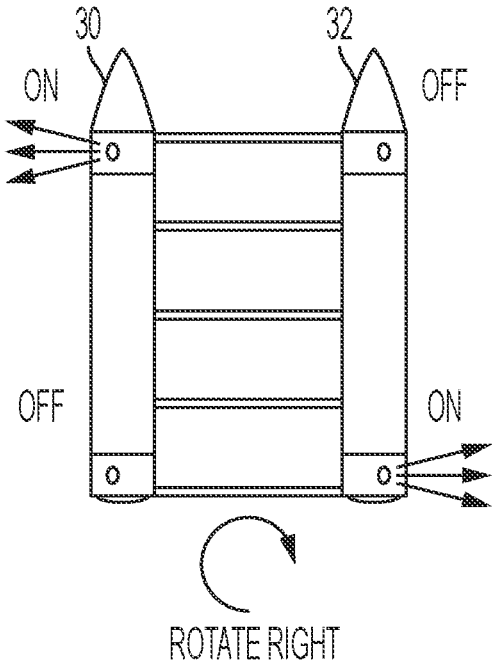
FIG. 3C is a diagram illustrating a third operating condition of the four thruster systems.
Figure 3D:
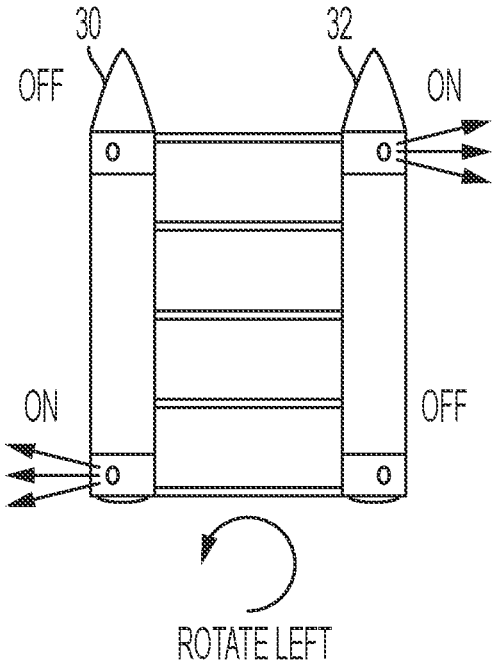
FIG. 3D is a diagram illustrating a fourth operating condition of the four thruster systems.

FIGS. 3A-3D show four different operational conditions associated with the two-pontoon—and four thruster system—configuration of FIG. 2. In particular, FIG. 3A illustrates both thrusters 10A on the first pontoon 30 being on and both thrusters 10B on the second pontoon 32 being off. This operational condition results in substantially translational movement of the marine vessel to one side (the right in the orientation of the Figures). FIG. 3B illustrates both thrusters 10B on the second pontoon 32 being on and both thrusters 10A on the first pontoon 30 being off. This operational condition results in substantially translational movement of the marine vessel to the other side (the left in the orientation of the Figures). FIG. 3C illustrates the forward thruster on the first pontoon 30 and the rearward thruster on the second pontoon 32 being on, with the rearward thruster on the first pontoon 30 and the forward thruster on the second pontoon 32 being off. This operational condition results in rotational movement of the marine vessel in a clockwise direction, as viewed in the Figures. FIG. 3D illustrates the forward thruster on the first pontoon 30 and the rearward thruster on the second pontoon 32 being off, with the rearward thruster on the first pontoon 30 and the forward thruster on the second pontoon 32 being on. This operational condition results in rotational movement of the marine vessel in a counter-clockwise direction, as viewed in the Figures.

Figure 4:
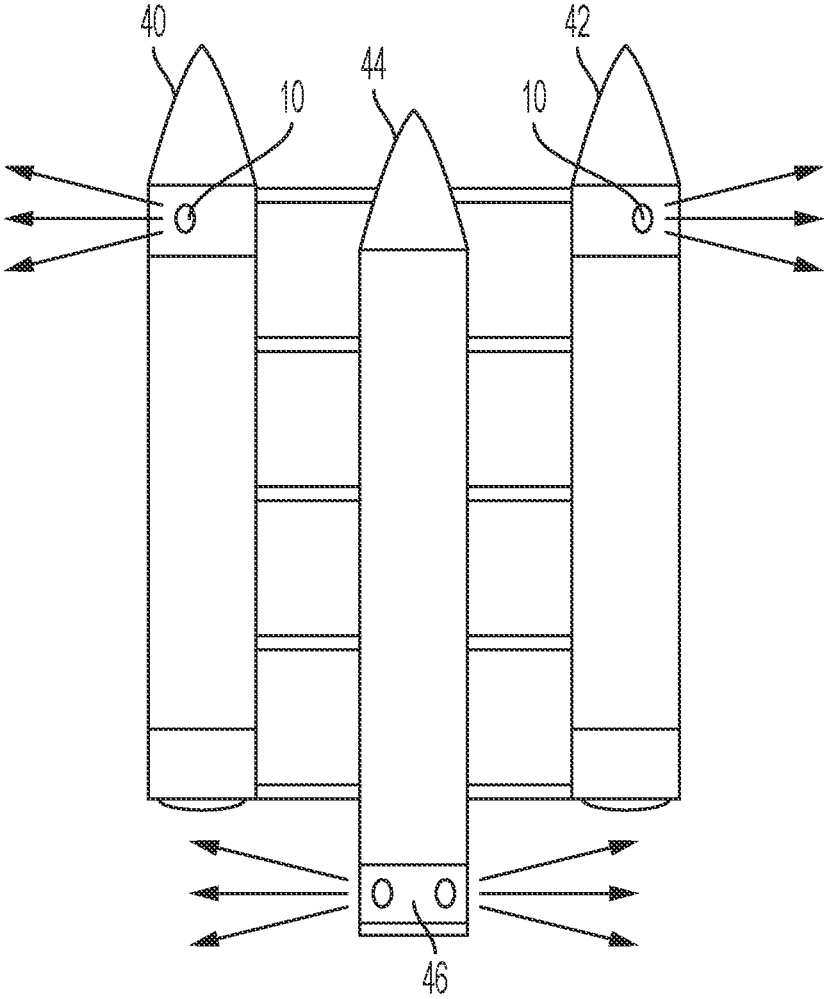
FIG. 4 is a schematic illustration of a three-pontoon boat show thrust directions of multiple thruster systems.
Figure 5B:
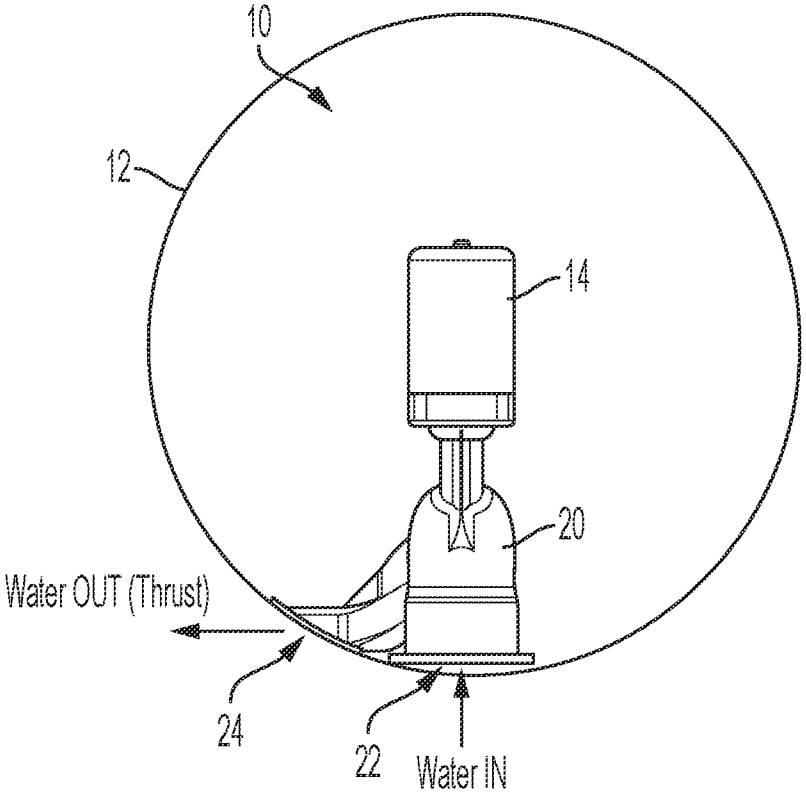
FIG. 5B is an elevation view of the thruster system of FIG. 5A, with an outline of a pontoon tube.
Figure 5A:
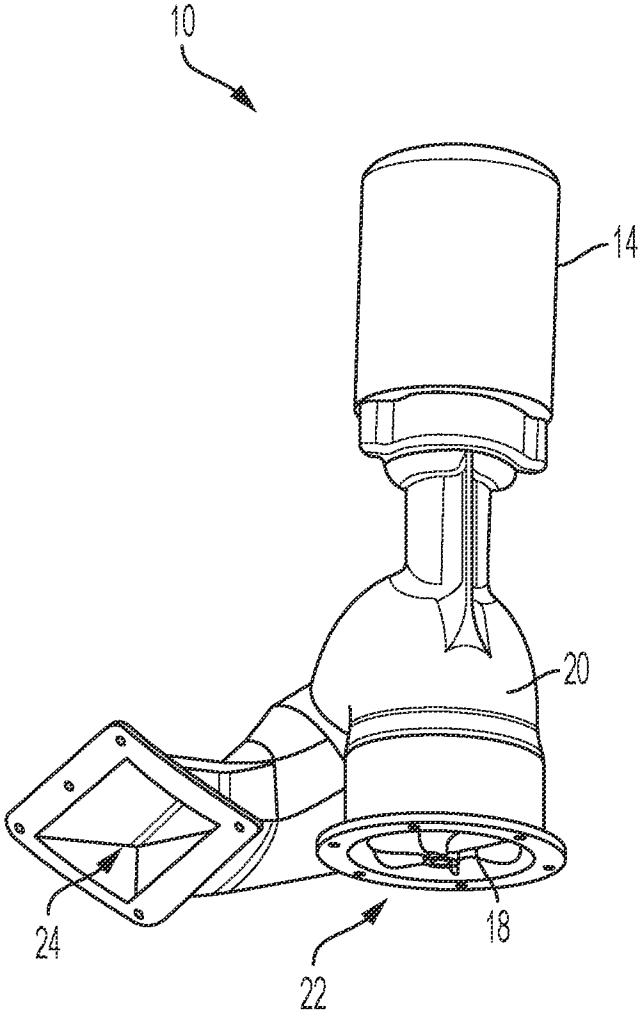
FIG. 5A is a perspective view of the thruster system according to one aspect of the disclosure.
Figure 6B:
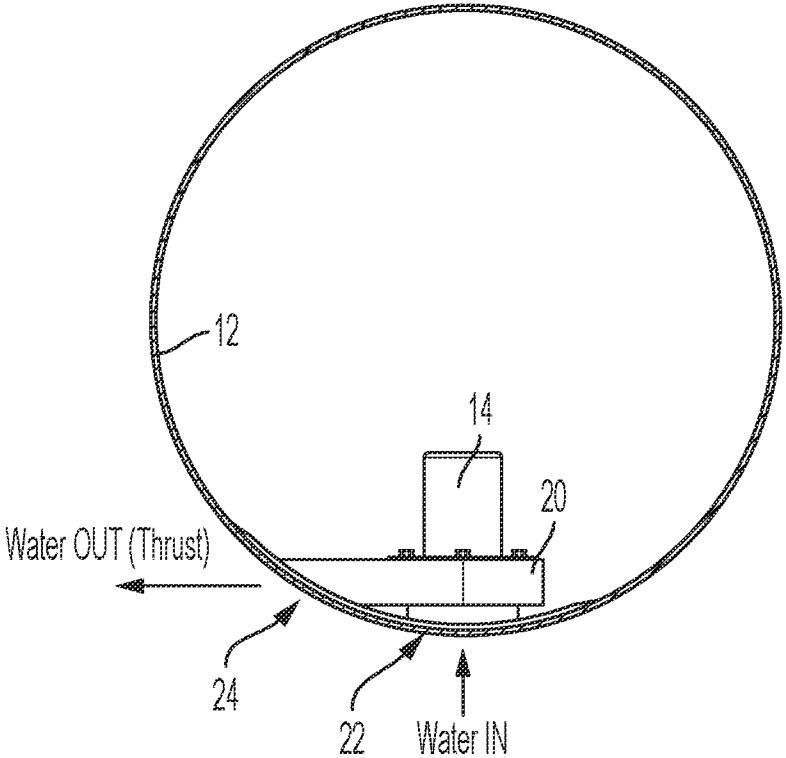
FIG. 6B is an elevation view of the thruster system of FIG. 6A, with an outline of a pontoon tube.
Figure 6A:
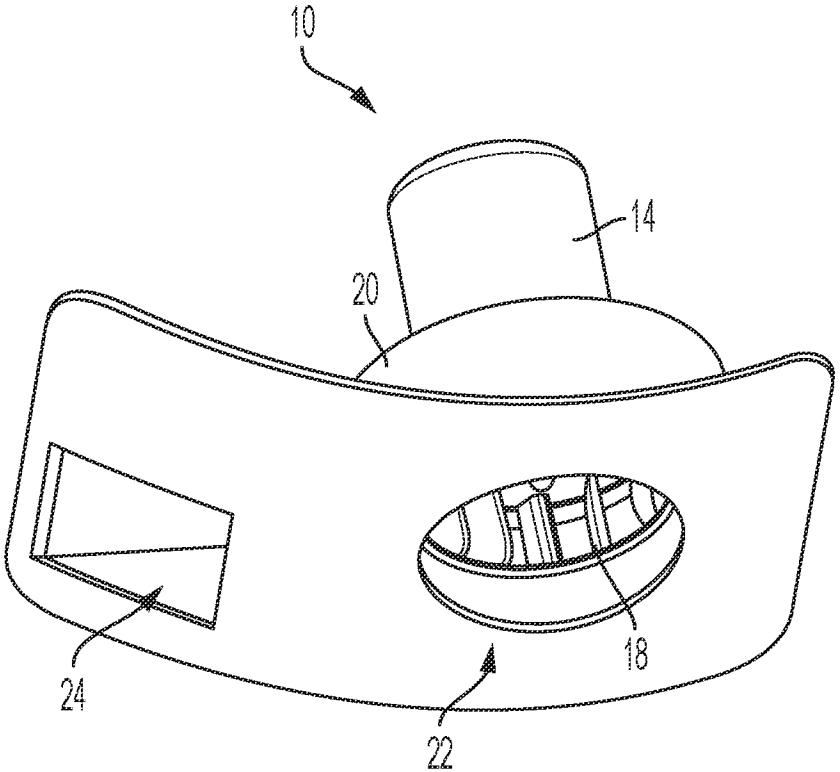
FIG. 6A is a perspective view of the thruster system according to another aspect of the disclosure.
Figure 7:
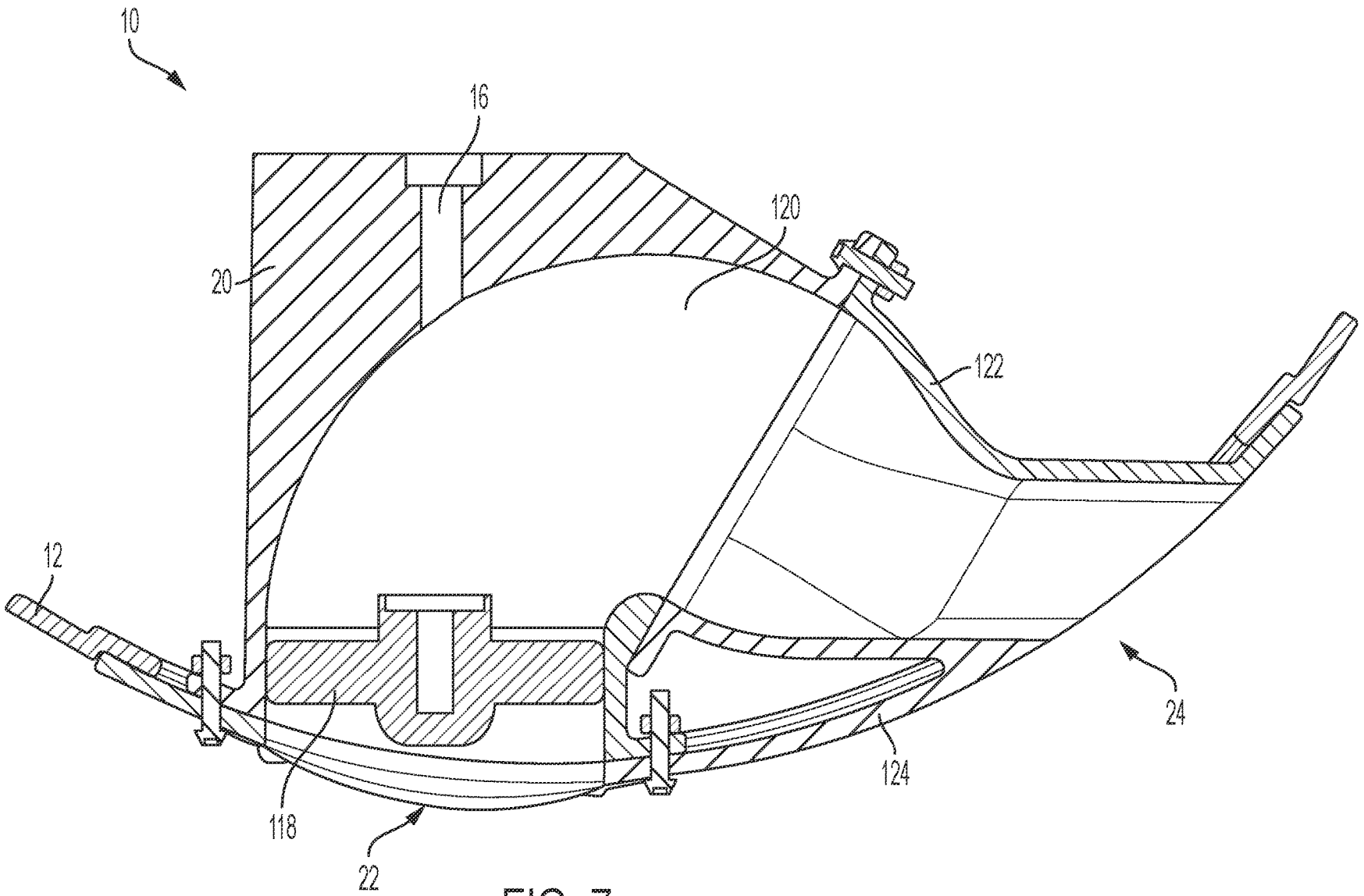
FIG. 7 is a cross-sectional view of the thruster system.

While the above operational situations are specific to a four thruster embodiment, it is to be understood that more or fewer thrusters 10 may be included in other embodiments. Similarly, the thruster systems 10 described herein are not limited to use with a two-pontoon boat, or even to a pontoon boat. For example, a three-pontoon configuration is illustrated in FIG. 4. In the three-pontoon configuration, the outer pontoons, referred to as a first pontoon 40 and a second pontoon 42, each include at least one thruster system 10 with respective discharge directions that are opposite to each other (i.e., outward from vessel). The middle pontoon 44, referred to herein as a third pontoon, includes a bi-directional (i.e., reversible) electrically driven thruster 46. In another embodiment, the third pontoon 44 may include two unidirectional thrusters 10 on opposite sides of the third pontoon 44. The other thrusters 10 are unidirectional to avoid motor and component complexity.

Figure 8:
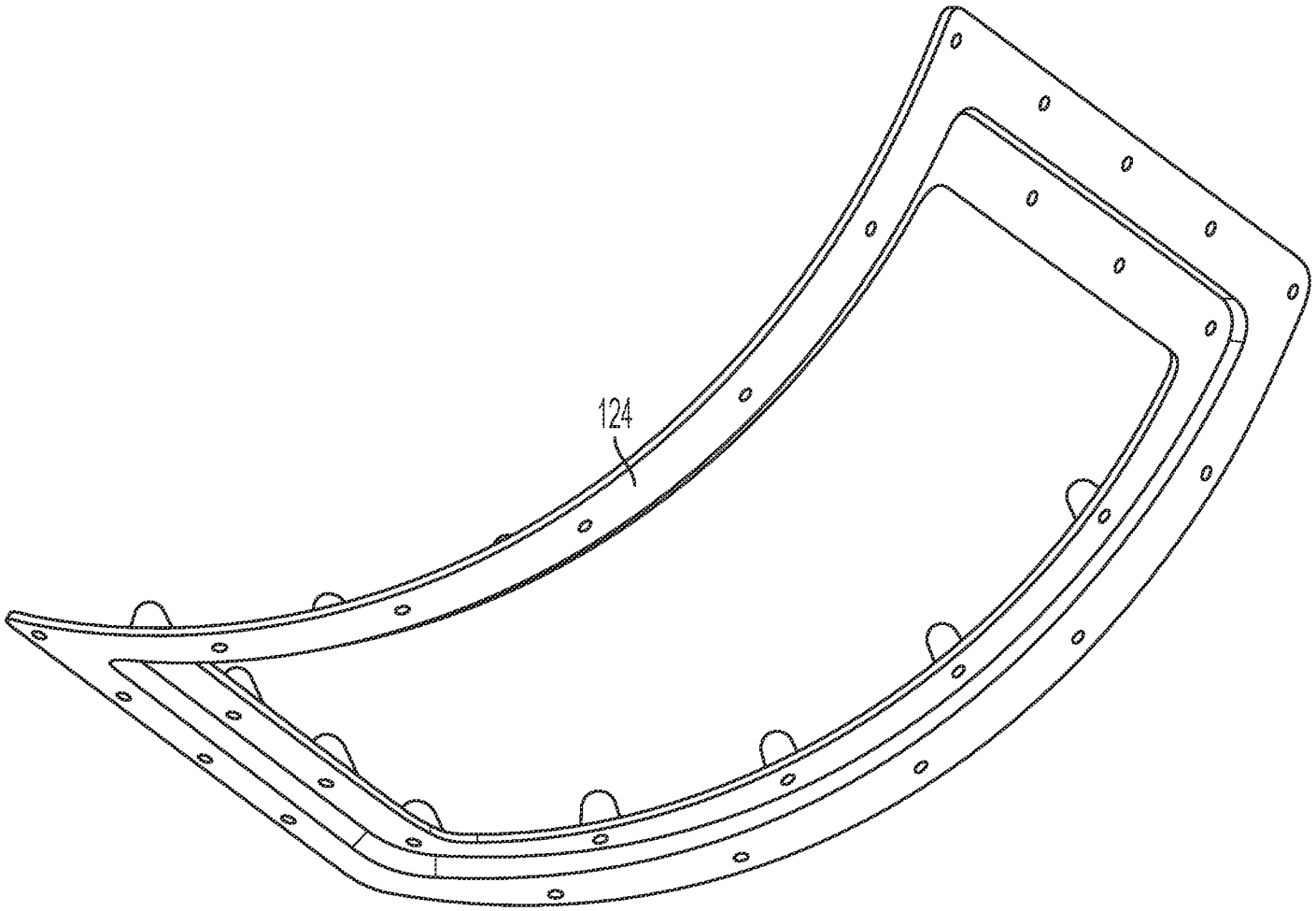
FIG. 8 is a perspective view of a flange of the thruster system.

FIGS. 5A-8 illustrate the thruster system 10 in more detail. The thruster system includes the driveshaft 16 operatively coupling the electric motor 14 to the rotatable member 18 within the pump housing 20, an intake opening 22 on the bottom portion of the housing 20, and a discharge opening 24 on a lower side of the pump housing 20. The embodiments of FIGS. 5-8 utilize a rotatable member that comprises an impeller 118. As shown, the thruster system of FIGS. 5-8 include the impeller 118 driven by the driveshaft 16 within the housing 20. The housing 20 defines a water flow path 120 that extends from the intake opening 22 to the discharge opening 24. The discharge opening 24 is part of a nozzle section 122 that couples to the housing 20. The nozzle section 122 is mechanically secured to the housing 20 with fasteners, such as bolts or the like. Alternatively, the nozzle section 122 may be integrally formed with the housing 20 in other embodiments. In some embodiments, the nozzle section 122 reduces the cross-sectional area of the water flow path 120 to increase the thrust provided. The nozzle section 122 is also operatively coupled to a flange 124. The flange 124 is a substantially rectangular component having curvature in some embodiments, as shown in FIG. 8. The flange 124 is mechanically fastened to the housing 20 and to the nozzle section 122, but it is to be appreciated that any or all of these components may be integrally formed with each other in some embodiments.

Figure 9B:
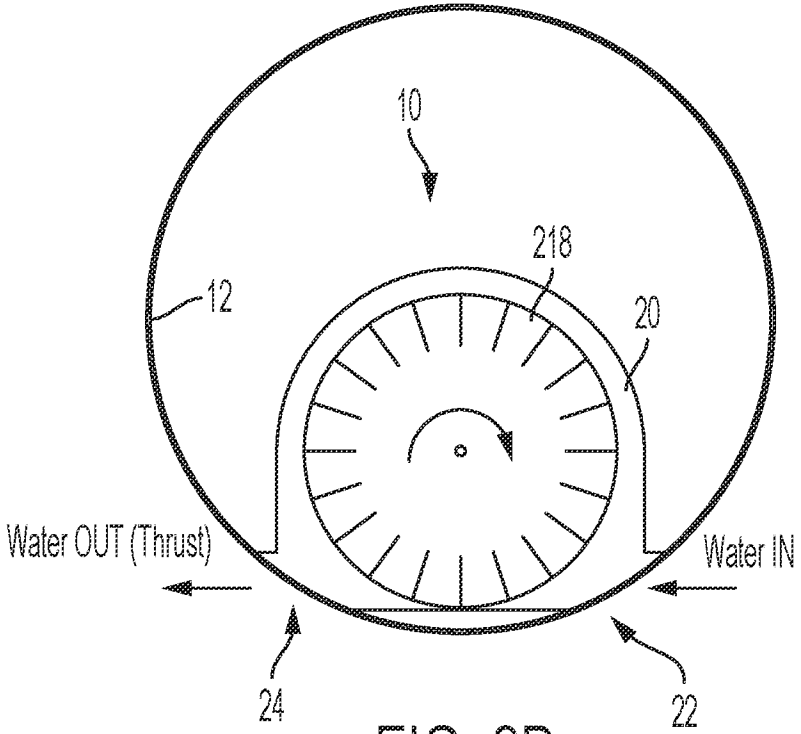
FIG. 9B is an elevation view of the thruster system of FIG. 9A, with an outline of a pontoon tube.
Figure 9A:
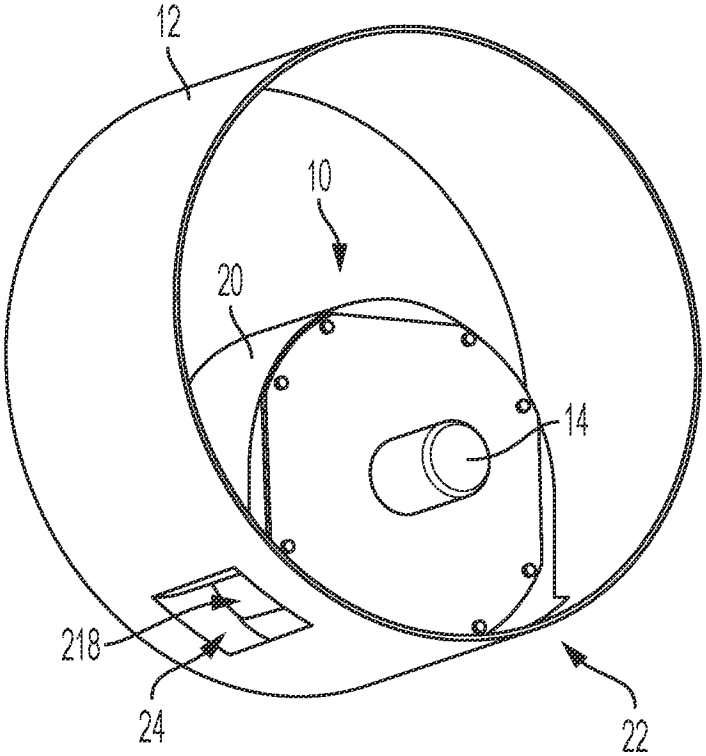
FIG. 9A is a perspective view of the thruster system according to another aspect of the disclosure.

FIG. 9 illustrates another embodiment of the thruster system 10. In the illustrated embodiment, the rotatable member is a turbine wheel 218 that facilitates the water intake and thrust. In particular, the pontoon 12 includes the intake opening 22 which allows water to be taken in and used to provide the thrust force during rotation of the turbine wheel 218 that is driven by the motor 14. The turbine wheel 218 ejects the water through the discharge opening 24.

Figure 10A:
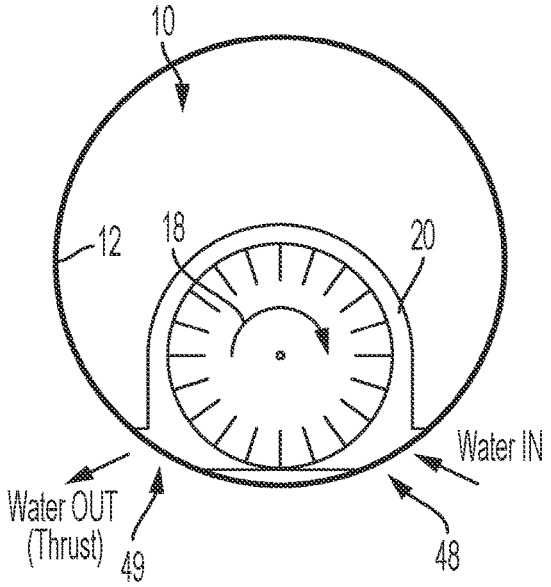
FIG. 10A is a diagram of a portion of a bidirectional thruster system operating in a first rotational condition.
Figure 10B:
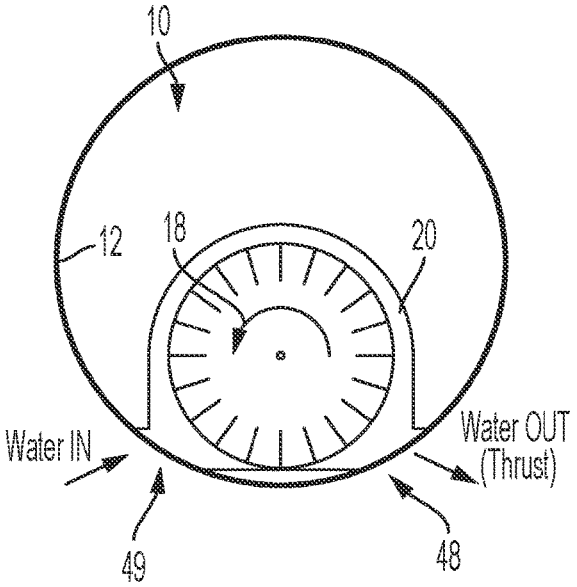
FIG. 10B is a diagram of the portion of the bidirectional thruster system operating in a second rotational condition.

FIGS. 10A and 10B illustrate a portion of the thruster system to show the bi-directional operational capability that may be utilized in some embodiments, such as the bi-directional thruster 46 shown in FIG. 4. Bi-directional capability may be effective on some hull configurations. In such embodiments, the openings (e.g., nozzles), shown as a first opening 48, representing an intake opening, and a second opening 49, representing a discharge opening, in FIGS. 10A and 10B, are oriented in a downward angle, relative to horizontal. For example, the openings 48, 49 may be angled between 5-10 degrees downward in some embodiments, and at about 7 degrees in some embodiments. Thus, the reduction in thrust from the Coanda effect could be avoided.

Figure 11:
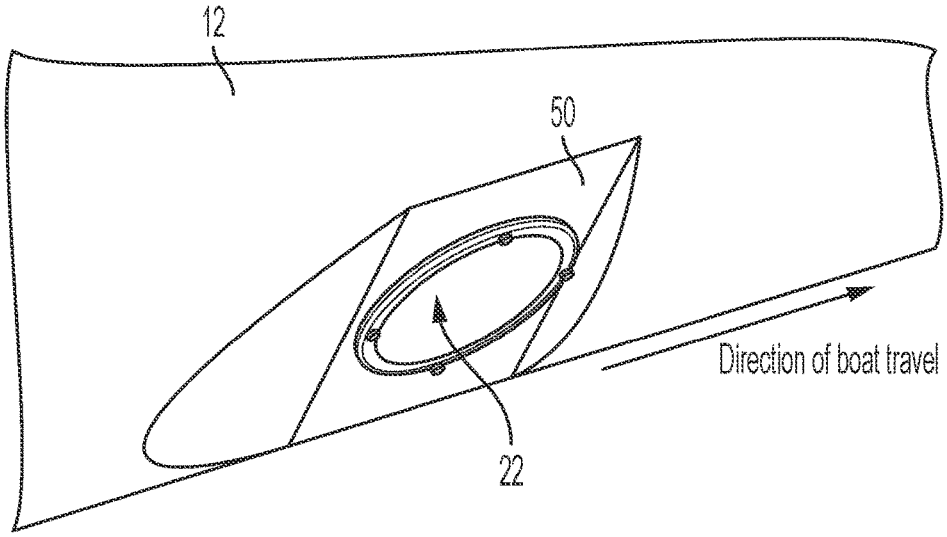
FIG. 11 is a perspective view of the thruster system having a step pocket on an outer portion of a pontoon.

FIG. 11 illustrates a stepped-hull pocket 50 that allows for clean water flow over the intake opening 22 at running speeds. This mounting configuration ensures that the motor 14 and electric components are kept out of water even if the housing 20 leaks.

Some of the embodiments disclosed herein rely on a bottom suction/side discharge orientation via discharge opening 24. The water is pulled up vertically—or substantially—through the bottom via the intake opening 22 of the hull (e.g., pontoon 12) into the housing 20, and then directed back down and discharged out of the housing 20 substantially perpendicular to the side of the boat hull. This jet of water causes the marine vessel to react by moving in the opposite direction. The discharge opening 24 is mounted low in the hull (e.g., pontoon 12) and 'fan' shaped in some embodiments to ensure underwater operation. The fan nozzle cross-sectional area may be equal to the cross-sectional area of the rotatable member 18 to help reduce flow restriction, or may be constricted to an amount to maximize thrust via the Venturi effect.

Figure 12:
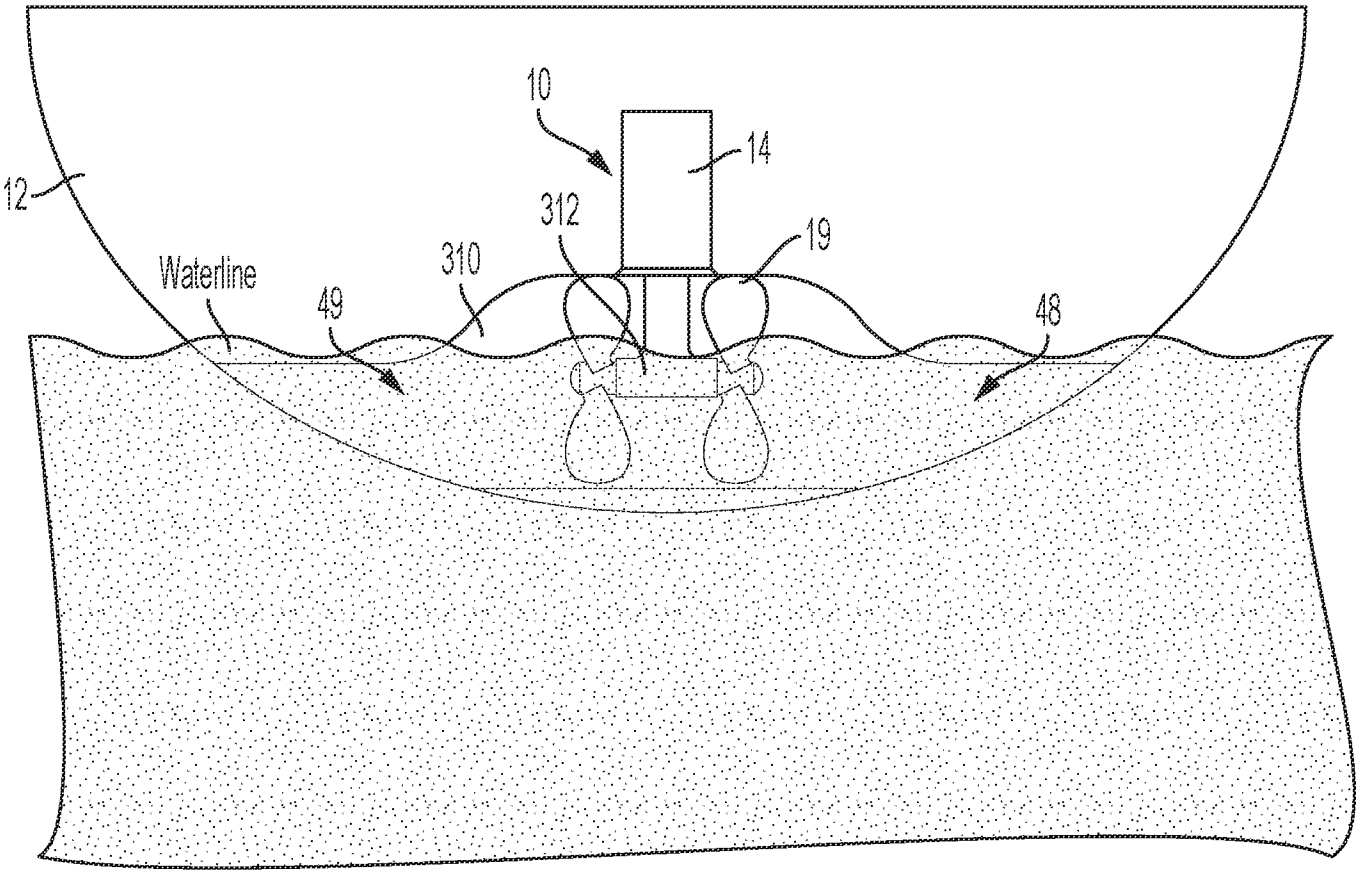
FIG. 12 is a diagram view of a bidirectional thruster system, according to one example.

FIG. 12 illustrates an embodiment of the thruster system 10 that has the intake and discharge below the waterline. In this embodiment, the thruster system 10 may include a tubular housing coupled to the pontoon 12 and at least one rotatable member 19 disposed within the tubular housing. In some embodiments, the rotatable member 19 is at least one bi-directional impeller that functions as an impeller in one direction of rotation and as a propeller in an opposite direction of rotation. As illustrated in FIG. 12, the tubular housing may define an upwardly extending recess 310. The recess 310 includes a height that is greater than a cross-sectional width of the rotatable member 19 in some embodiments. The recess 310 may be defined in various locations, so long as it is between the intake opening 48 and the discharge opening 49. For example, the recess 310 may be located in a generally center position below the electric motor 14 and between the intake opening 48 and the discharge opening 49, as illustrated in FIG. 12. The recess 310 is configured to house the least one rotatable member 310. In practice, the recess 310 is configured to allow air to discharge out of the tubular housing via the intake opening 48 and/or the discharge opening 49, and allow the water to fill a volume inside the tubular housing and recess 310 such that the rotatable member 19 is continuously submerged in the water. As shown, a gear box 312 may operatively connect the motor output to the rotatable member(s) 19.

Referring further to FIG. 12, the tubular housing may have a first housing opening that is proximate a first pontoon edge, a second housing opening that is proximate a second pontoon edge. A length of the tubular housing is measured from the first housing opening to the second housing opening, wherein the length is substantially perpendicular to a longitudinal direction of the pontoon. In some embodiments, the first housing opening and the second housing opening may be at least one nozzle that is oriented in a marine vessel downward angle. For example, the openings may be angled between about 5-10 degrees in some embodiments, and at about 7 degrees in other embodiments, such that the reduction in thrust from the Coanda effect could be avoided. In practice, the first housing opening and the second housing opening may both operate as an intake and/or a discharge, depending on the rotation of the bi-directional impeller. It is generally contemplated that the tubular housing may include additional housing openings, such as a third housing opening and a fourth housing opening, or additional openings, so long as the housing openings may operate as the intake and/or the discharge. By defining a low intake and discharge, in tandem with the continuously submerged rotatable member, the thruster system is able to intake and discharge water below the water line without having to draw the water substantially upwards towards the rotatable member.

Referring again to FIG. 12, the thruster system may include a linear actuator. The linear actuator may be coupled to the drive shaft of the motor and to the tubular housing. In operation, the linear actuator can allow the tubular housing and the rotatable member coupled to the drive shaft to actively change position such that the rotatable member is continuously submerged in water.

Figure 13:
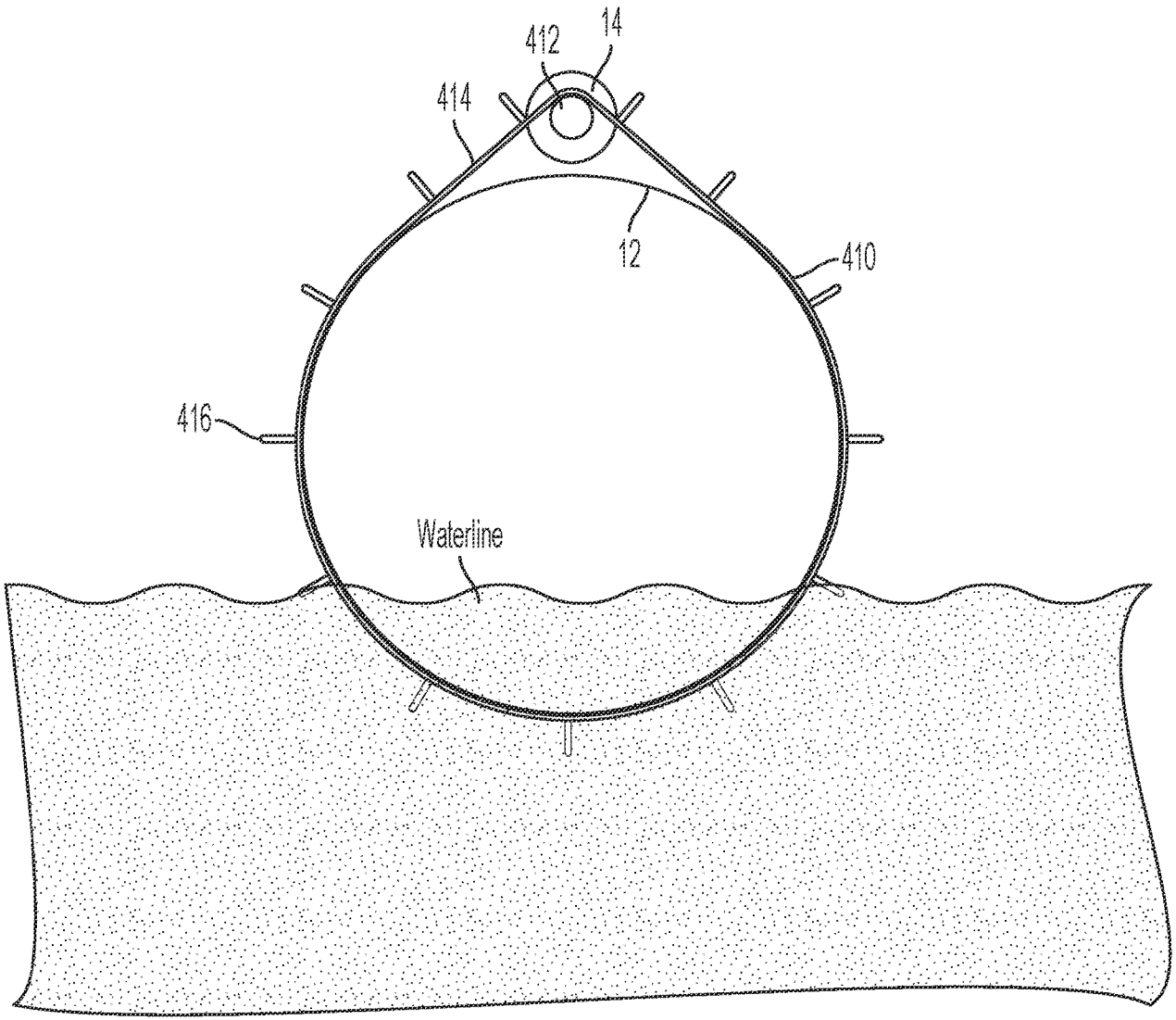
FIG. 13 is a diagram view of a thruster system having a belt with a plurality of paddles along a periphery of a pontoon, according to one example.

FIG. 13 illustrates an embodiment of the thruster system that includes a paddle wheel 410 defined along an outside periphery of the pontoon and at least partially in operable contact with the water. In some embodiments, the paddle wheel 410 includes a motor 14 with an output shaft 412 and a belt 414. The belt 414 is disposed along the outside periphery of the pontoon 12 in some embodiments, where the belt 414 is driven by the motor 14 via a coupling with the belt 414, and a plurality of paddles 416 are coupled to an outside portion of the belt 414. In this embodiment, a portion of the paddle wheel 410 is at least partially below the water level, such that belt 414 and at least a portion of the paddles 416 are continuously in contact with the water when the boat is deployed in the water. In other configurations, the paddle wheel 410 may be coupled to an interior shaft that is disposed within a cavity defined within the pontoon and is concentric with the pontoon. In this configuration, the belt 414 may be coupled to an outside periphery of the interior shaft, the plurality of paddles 416 may be coupled to the belt 414 and extend outward from the outside periphery of the interior shaft and towards an inside surface of the pontoon, and the motor 14 may be disposed within the cavity. In yet other configurations, the paddle wheel 410 may be mounted in a slot around the center axis of the pontoon, wherein the slot has a depth that is generally equal to a height of at least one paddle 416. It is generally contemplated that a plurality of paddle wheels 410 may be disposed throughout the boat. For example, a paddle wheel may be disposed on a front and/or rear portion of a first pontoon and/or a second pontoon.

Referring further to FIG. 13, the paddle wheel 410 is configured to move in a bi-directional manner, such that the paddle wheel 410 may move in a clockwise or counter-clockwise direction. In particular, the output shaft of the motor 14 is configured to rotate in a bi-directional manner (e.g., clockwise direction, counter-clockwise direction), which in turn, allows the belt and the plurality of paddles to travel in either a clockwise direction or counter-clockwise direction around the outside periphery of the pontoon. This movement of the paddle wheel 410 causes the plurality of paddles 416 to contact the water and generate a force, wherein the force causes the boat to move in an opposite direction. For example, the boat may have a first paddle wheel disposed on the front-portion of a first pontoon and a second paddle wheel disposed on the rear portion of a second pontoon, wherein the first paddle wheel is rotating in a clockwise direction and the second paddle wheel in a counter-clockwise direction, causing the boat to subsequently rotate, as illustrated in FIG. 3C.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description.

Having thus described the invention, it is claimed:

1. A thruster system for a marine vessel comprising:

an electric motor having an output shaft;

a housing having an intake opening and a discharge opening, the intake opening defining a water intake, the discharge opening being a single discharge opening and the only opening defining a water discharge, wherein the intake opening and the discharge opening define a water flow path;

a rotatable member operatively coupled to, and driven by, the output shaft of the electric motor, wherein rotation of the rotatable member results in water brought into the housing through the intake opening and expelled through the discharge opening to generate a thrust force in a direction that is greater than 45 degrees relative to a propeller direction of the marine vessel, wherein the discharge opening which defines the water discharge is oriented downwardly at an angle of 5 degrees to 10 degrees, relative to a horizontal plane extending perpendicularly from a vertical water intake flow, to cause the entirety of water flowing through the water flow path to be expelled downwardly; and a flange having a curved shape, the flange mechanically fastened to the housing and a hull to assemble the housing to the hull.

2. The thruster system of claim 1, wherein the intake opening is located at a bottom portion of the housing and the discharge opening is located at a side portion of the housing.

3. The thruster system of claim 1, wherein the housing is a tubular housing that is at least partially below a waterline, and wherein the tubular housing defines a recess that at least partially houses the rotatable member.

4. The thruster system of claim 3, wherein a distance between the intake opening and the discharge opening defines a length of the tubular housing, and wherein the length of the tubular housing is generally perpendicular to a marine vessel-rearward to a marine vessel-forward length of the marine vessel.

5. The thruster system of claim 4, wherein the recess is configured to allow water to continuously submerge the rotatable member.

6. The thruster system for the marine vessel of claim 1, wherein the thrust force direction is perpendicular to the propeller direction of the marine vessel.

7. The thruster system for the marine vessel of claim 1, wherein the rotatable member is an impeller.

8. The thruster system for the marine vessel of claim 1, wherein the thruster system is permanently mounted to the hull of the marine vessel.

9. The thruster system for the marine vessel of claim 1, wherein the thruster system is permanently mounted to a pontoon of the marine vessel.

* * * * *